United States Patent [19]

Beck et al.

[11] Patent Number: 4,995,465

[45] Date of Patent: Feb. 26, 1991

[54] ROTARY DRILLSTRING GUIDANCE BY FEEDRATE OSCILLATION

[75] Inventors: Jeffrey L. Beck, Centerfield, Utah; Larry D. Taylor, Morgantown, W. Va.

[73] Assignee: Conoco Inc., Ponca City, Okla.

[21] Appl. No.: 441,788

[22] Filed: Nov. 27, 1989

[51] Int. Cl.[5] ..... E21B 3/92; E21B 7/08

[52] U.S. Cl. ..... 175/27; 175/40; 175/45; 175/61; 175/75; 175/76; 175/162

[58] Field of Search ..... 175/27, 24, 26, 45, 175/73–75, 104, 107, 203, 122, 162

[56] References Cited

U.S. PATENT DOCUMENTS

| | | | |
|---|---|---|---|
| 4,305,474 | 12/1981 | Farris et al. | 175/73 |
| 4,461,349 | 7/1984 | Wunderlich | 166/245 |
| 4,471,843 | 9/1984 | Jones et al. | 175/73 |
| 4,662,458 | 5/1987 | Ho | 175/27 |
| 4,667,751 | 5/1987 | Geczy et al. | 175/61 |
| 4,697,651 | 10/1987 | Dellinger | 175/61 |
| 4,733,733 | 3/1988 | Bradley et al. | 175/45 |
| 4,739,842 | 4/1988 | Kruger et al. | 175/75 X |
| 4,854,397 | 8/1989 | Warren et al. | 175/27 X |
| 4,875,530 | 10/1989 | Frink et al. | 175/27 |
| 4,880,066 | 11/1989 | Steiginga et al. | 175/75 |

FOREIGN PATENT DOCUMENTS 2066878 7/1981 United Kingdom .

*Primary Examiner*—Stephen J. Novosad

[57] ABSTRACT

A drilling method and apparatus for directional drilling of a borehole. The apparatus includes a retrievably mounted downhole monitor for sensing parameters of the drill rod to which a drill bit is attached. A bent-sub is connected with said drill rod behind the drill bit to position the drill bit to extend angularly with respect to the drill rod. An actuator such as a hydraulic ram is provided for exerting thrust along the axis of the drill rod on said drill bit. The drill rod and drill bit is not rotated with the use of a downhole motor. Based upon the signals received from the downhole monitor, the drill rod and bit are pulsed to effect the desired trajectory of the drilling.

12 Claims, 2 Drawing Sheets

ROTARY DRILLSTRING GUIDANCE BY FEEDRATE OSCILLATION

BACKGROUND OF THE INVENTION

1. Field of the Invention

This invention relates to a method and apparatus for the guidance of the advance of a rotary drillstring, and more particularly to a method and apparatus for maintaining or controlling the trajectory of a rotating drill bit by modulating the :thrust on the drill bit in synchronization with the rotation of the drill rod. The present invention is contemplated for use in coal mine drilling and in oil field directional drilling.

The primary factors affecting the direction of rotary drilling are drill bit thrust, or weight-on-bit (WOB), and the rotational speed of the drill bit. Generally, with regard to a horizontal drillstring, increasing the thrust and increasing the rotational speed tend to cause a downward effect on the trajectory, while increasing the thrust and reducing the rotational speed tend to cause an upward trajectory.

2. The Prior Art

Heretofore, there have been several approaches taken to maintain a rotary drill bit trajectory along a desired path and upon which the present invention improves. It is known that positioning a stabilizer or centralizer on the drill rod near the drill bit increases the tendency of the bit to move upwardly, and positioning the stabilizer a greater distance behind the bit tends to cause a downward trajectory of the bit. Using prior art procedures, it was necessary, upon encountering a downward dip in a coal bed, for example, to remove the drillstring from the hole and remove or add a stabilizer adjacent the bit. It is also known that, in a horizontal bore, the drill bit will turn downward when there is low thrust and no hard interface below the drillstring, and it will turn upward when there is high thrust and no hard interface or layer above the drillstring.

In another procedure, directional drilling is achieved by inserting, at the downhole end of a drillstring, a small section of pipe called a sub which has been bent, i.e., a bent-sub, such that the longitudinal axis of one of its ends is at a slight angle to the other end. In practice, a borehole is drilled to a predetermined length and the drillstring is then withdrawn and a bent-sub having the desired offset angle is inserted between the end of the drillstring and a downhole motor. The drillstring is then inserted back into the borehole and, since the longitudinal axis of the drill bit is then at an angle to the original borehole due to the bent-sub, the direction of the borehole is altered. The bent-sub may be replaced any number of times in order to provide a borehole of the desired shape and configuration. U.S. Pat. No. 4,697,651 to Thomas B. Dellinger discloses such a bent-sub with a downhole drill motor and a monitoring device.

The use of downhole motors, however, tends to increase the cost of any given drilling operation due to the significant chance of loosing a drillstring. With such a loss, the cost of both the downhole motor and the instrument package would be incurred.

Another method of guiding the drill bit along the designated path is by means of a deflection operation carried out at a second location spaced longitudinally along the drillstring from the drill bit. This deflection operation involves repeatedly deflecting the drillstring from its axis in a radial direction during rotation of the drillstring. This guidance system comprises a segment member adapted to be inserted into the bore hole as a portion of the drillstring. This segment is provided with deflectors which are cyclically actuated between projected and retracted positions to change direction of the drill bit. Examples of this are disclosed in U.S. Pat. Nos. 4,461,349 and 4,471,843 to Emrys H. Jones, Jr. and Ronald W. Umphrey, and British patent application No. 2,066,878 to Heinz Wallussek et al. U.S. Pat. No. 4.305,474 to Nathandale Farris et al. discloses a guidance system with deflectors that also includes a downhole motor in which the deflectors are actuated when a lower than normal thrust is imposed on the drillstring and an opposite perpendicular force is exerted when a higher than normal thrust is imposed on the drillstring. When normal thrust is being used, the device does not cause deflection in either direction.

It is also known to provide monitoring devices to control the trajectory while drilling as disclosed, for example, in U.S. Pat. No. 4,733,733 to William B. Bradley et al., and in U.S. Pat. No. 4,471,843 to Jones et al., mentioned above.

SUMMARY OF THE INVENTION

According to the present invention, the direction of a rotary drillstring is measured without pulling the drillstring from the borehole. The direction of the rotary drillstring is changed in response to a change outside of the borehole, and a controller senses the change in direction so that adjustments may be made to obtain the desired direction of drilling. A bent-sub is used near the drill bit to control direction. By modulating the thrust in synchronization with the rotation of the drill rod, the direction of the drill bit is controlled.

That is, the orientation of the bent-sub as a function of time is monitored. The weight on the bit, or thrust, is pulsed in time synchronization with the position of the bent-sub. If it is desired to increase the angle, i.e., to build the angle of the hole, the thrust is increased when the bent-sub is positioned to extend in the desired direction. The maximum angle build rate is obtained when the thrust is applied at some maximum value when the bent-sub is properly oriented and the thrust is zero at all other times. Intermediate build rates can be accomplished by a less precise application of the thrust on the bit. If the thrust is constant, the drill bit will cut substantially in the same manner as if there were no bent-sub.

In carrying out the present invention, directional control may be obtained using conventional rotary equipment. Further, expensive equipment such as a downhole motor is not needed. The downhole monitoring equipment is also, therefore, more easily retrievable. By eliminating the downhole motor and making the monitor retrievable, the economic impact of losing such equipment is eliminated.

The present invention also compensates for the existence of a certain amount of wind-up in the drillstring as well as for the reaction delay in transmitting a thrust pulse along the length of the drillstring to the drill bit, which create phase shifts between the application of the thrust and the cutting of the bit at maximum thrust during the rotation of the drillstring and drill bit.

Various other features, advantages, and characteristics of the invention will become apparent to those skilled in the art upon reading the following description in conjunction with the accompanying drawings.

DETAILED DESCRIPTION OF THE PREFERRED EMBODIMENTS

Figure 1:
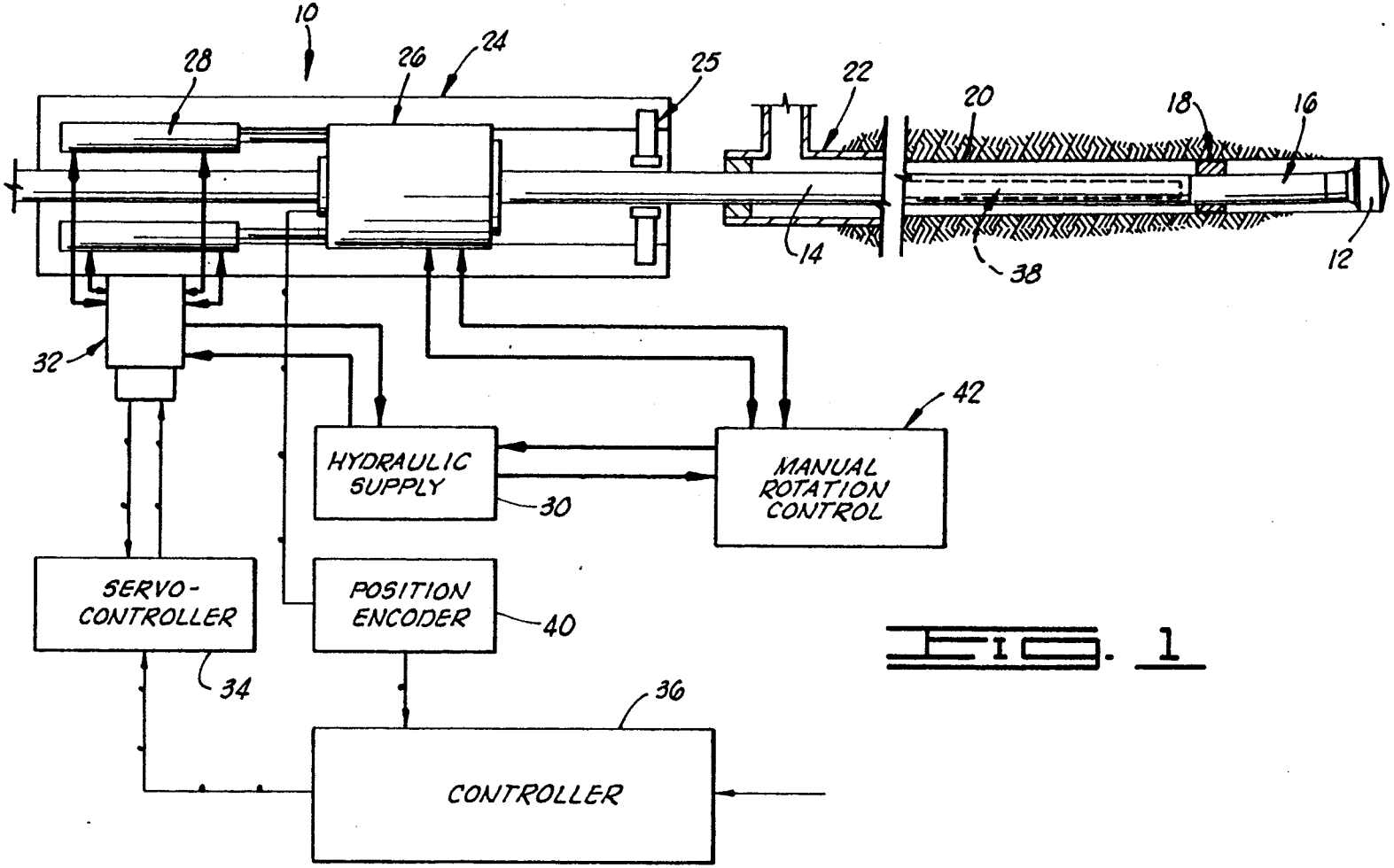
FIG. 1 is a schematic illustration of the basic elements of the present invention.

The principle elements of the drilling device 10 of the present invention are shown schematically in FIG. 1. A drill bit 12 is attached to a drill rod 14, which is part of a drillstring. A bent-sub 16 is attached to the drill rod a short distance behind the drill bit 12 by known procedures. An eccentric stabilizer 18 is attached to and cooperates with the bent-sub to maintain the drill bit 12 centered in borehole 20. Further, a conventional casing 22 surrounds a portion of the drillstring. Because of the bend at the bent-sub, the drillstring immediately behind the bit must orbit the axis of the borehole at some very small radius. There are many combinations of stabilizers and stabilizer spacings that could be used, several of which would be suitable for a given situation. The only restriction is that there cannot be a concentric stabilizer near the bent-sub if the bent-sub is a single bend type.

Further, many types of known drill bits could be used with the present invention. The present invention is particularly suited to the use of polycrystalline diamond bits.

A drill carriage 24 is located outside the borehole 20 and is attached to the drillstring. Conventional clamping apparatus 25 for the drill rod is utilized in the drilling device 10. A rotary power device 26 is located within the drill carriage 24 to rotate the drillstring and to thereby rotate the drill bit 12.

Piston-cylinder actuators 28, hydraulic rams. e.g., are located in the drill carriage 24 to provide a thrust on the drillstring and to thereby selectively vary the weight-on-bit. Fluid is supplied to the cylinders of the actuators from a hydraulic supply 30, which may include a pump, through servo-valve 32 which is controlled by servo-controller 34. The servo-controller is controlled by controller 36 which interprets data supplied by a retrievable downhole monitor 38, such as azimuth, roll and pitch data. The controller then determines what the oscillatory amplitude and phase angle should be to achieve the desired rate of curvature and direction of the path of the drill bit. U.S. Pat. No. 4,164,871 to Charles F. Cole and Jimmie H. Elemburg, and U.S. Pat. No. 4,733,733 to William B. Bradley and John E. Fontenot disclose sensors which can be incorporated in a monitor.

A position encoder 40 senses the position of the drill carriage and the drill bit 12. This data is fed into the controller 36 to generate an output signal to servo-valve 32 to control cylinders 28 to thereby exert a thrust on the drillstring and drill bit. Position or velocity transducers may also be used to provide feedback signals. A manual rotation control 42 is also provided in the event manual control is also desired or necessary.

Figure 2:
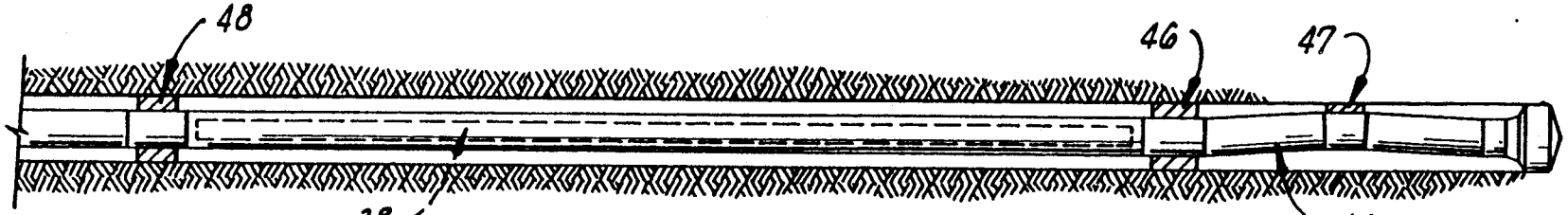
FIG. 2 is an alternate embodiment of the bent-sub arrangement.

Instead of using the bent-sub of FIG. 1, a double-bent-sub 44 may be used, as shown in FIG. 2. This double-bent configuration removes the need for eccentric stabilizers. In this case, a concentric stabilizer 46 is used behind the double-bent-sub. Other concentric stabilizers such as 48 may also be used. Further in such an arrangement, a wear pad 47 can be used, if desired, as shown in FIG. 2 to protect and prolong the useful life of the double-bent-sub.

The direction of the drill bit is controlled by modulating the thrust in synchronization with the rotation of the drill rod. If the thrust is constant, the drill bit cuts in substantially the same manner as if there were no bent-sub. In a horizontal borehole, the bit will turn downward when there is low thrust and no hard interface below the drill bit, and it will turn upward when there is high thrust and no hard interface above the drill bit.

Figure 3:
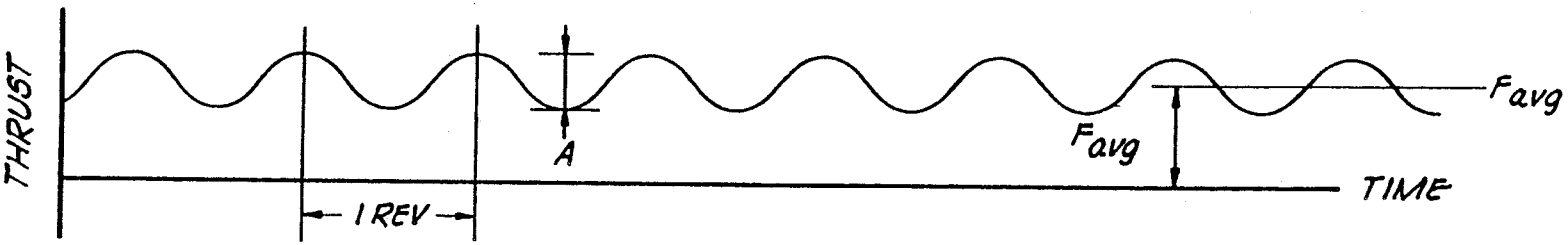
FIG. 3 shows a plot of thrust on the drill bit versus time.

A plot of thrust on the drill bit versus time is shown in FIG. 3. If the amplitude A is zero there would be no oscillation and the drillstring would behave as if there were no bent-sub. A high average thrust ($F_{avg}$) would make the drill bit go upwardly, and a low average thrust would make it go downwardly. If the amplitude A is greater than zero, the drill bit should deflect roughly in the direction that the bent-sub is pointing when maximum thrust is applied at the bit.

The velocity of the wave propagation through the drillstring and the rotational speed may create a significant lag and phase angle shift between the time the thrust is applied and when it reaches the drill bit. In order for the drillstring to move in the desired direction, the normal wind-up of the drillstring, due to torsional forces as it is rotationally driven, must be considered in addition to the phase shift between the thrust and the cutting at the bit. If there is a significant amount of wind-up in the drillstring as the thrust at the bit rises, maximum cutting might not occur in phase with the peak thrust.

Figure 4:
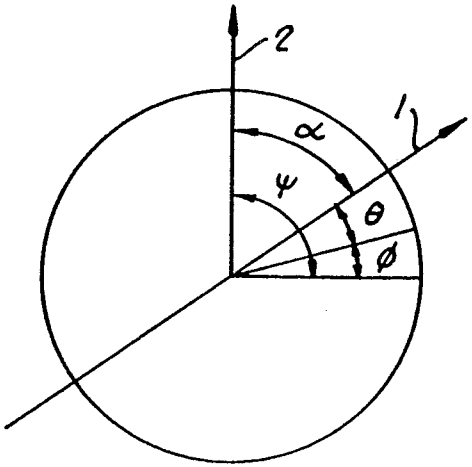
FIG. 4 is a graphical representation of the effect of wind-up of the drillstring and the phase shift between thrust and cutting at the bit.

The phase shifts mentioned above are shown graphically in FIG. 4, in which theta ($\theta$) equals the phase shift between maximum cutting and a given peripheral point, or mark, on the bent-sub at maximum thrust; phi ($\phi$) equals the lag due to wave propagation velocity through the drillstring; psi ($\psi$) equals the average wind-up or the wind-up at a specific time; and alpha ($\alpha$) equals the lag/lead between the thrust and the cutting angle. Arrow 1 is the desired deflection direction of the bit which should be the direction of maximum cutting (neglecting gravity). Arrow 2 is the direction of a mark on the drillstring when the thrust is at a maximum. Both the mark and the thrust referred to are at the drill rig. With reference to FIG. 4, when the drillstring is at rest with no torque on it, and the mark is at the top in FIG. 4, the bent-sub would also be pointed upwardly at whatever angle it is bent.

Although it is envisioned that the direction of the rotary drillstring could be controlled on a continuous basis, the presently preferred embodiment contemplates making heading corrections approximately every twenty feet.

Further, although the present invention is contemplated for use with an otherwise conventional oil well drawworks system, a modified embodiment tends to reduce, to some extent, the aforementioned considerations directed to the phase shift between the initiation of a pulse on the drill bit and, due to the time required for wave propagation and wind-up in the drillstring. Such a modified embodiment uses a hydraulic cylinder arrangement below the hook from which the drillstring extends. The hydraulic cylinder arrangement is then used to pulse the bit weight, while the drawworks controls the overall bit weight. U.S. Pat. No. 4,535,972 to Keith K. Millheim and Tom M. Warren and U.S. Pat. No. 4,660,656 to Tommy M. Warren, Warren J. Winters, and J. Ford Brett disclose such a hydraulic cylinder arrangement in a drilling rig. In this embodiment, the response time which otherwise would be needed from brake to drum to block for transmitting a pulse on the drill bit would be eliminated, thereby eliminating any unreliability in the consistency e.g., of that segment of the delay in response contributing to the aforementioned phase shift considerations.

In operation of the apparatus of the present invention, the drillstring is inserted into a borehole and the thrust is set to pulse in phase with the rotation of the drill bit. That is, and preferably using digital control, the operator would set a maximum feedrate, or thrust, on the bit. The survey instrument, or monitor, would then transmit azimuth, roll, and pitch data which would be used by the operator or controller to determine what the oscillatory amplitude and phase angle should be to achieve the desired rate of curvature and direction, respectively of the hole being drilled. These parameters would be entered into the control algorithm, which would then use the position encoder signal and the angular velocity and/or thrust signals to generate an output to the servovalve controlling the drill carriage. Depending upon the "sloppiness" of the particular carriage system being used, it may also be necessary to include position or velocity transducers on the drill carriage.

The monitor used is a wireline steering tool which is constructed, in the manner mentioned previously, to give instantaneous tool face measurements in a continuous immediate manner. The instantaneous tool face readings can be used to drive a valve on the power fluid lines to the hydraulic rams. The thrust on the bit would be varied by the rams to control the direction of the bit.

After a few feet of drilling, based upon the readings from the downhole monitor, the thrust pulse may be set to fire earlier or later. The weight applied may be increased or decreased depending on the desired trajectory. The only time the drillstring would have to be removed would be for changing bits and installing casing, thereby eliminating removal for changes of downhole motors or for using different bent-subs. This assembly can be used in vertical or horizontal boreholes as well as in areas that need crooked holes. This system allows a higher average thrust and therefore higher penetration rates.

Thus, it is seen that the method and apparatus of the present invention achieve the objects and advantages mentioned as well as those which are inherent therein. While certain preferred embodiments of the present invention have been illustrated and described for the purposes of the present disclosure, changes in the arrangement and construction of parts may be made by those skilled in the art, which changes are encompassed within the scope and spirit of the present invention as defined by the following claims.

We claim:

1. A drilling apparatus for drilling a borehole comprising:
(a) a drill rod having a drill bit;
(b) a bent-sub connected with said drill rod behind said drill bit to position said drill bit to extend angularly with respect to said drill rod;
(c) means for exerting thrust along the axis of said drill rod on said drill bit;
(d) means for rotating said drill rod and said drill bit; and
(e) means for controlling said means for exerting thrust, comprising means for selectively exerting thrust on said drill bit along said drill rod at predetermined angular positions of the drill bit as said drill rod rotates.

2. The drilling apparatus of claim 1, wherein said means for rotating said drill rod is located outside said borehole.

3. A drilling apparatus for drilling a borehole comprising:
(a) a drill rod having a drill bit;
(b) a bent-sub connected with said drill rod behind said drill bit to position said drill bit to extend angularly with respect to said drill rod;
(c) means for exerting thrust along the axis of said drill rod on said drill bit;
(d) means for rotating said drill rod and said drill bit;
(e) means for monitoring the angular position of said bent-sub;
(f) means for controlling said means for exerting thrust, comprising means for selectively exerting thrust on said drill bit along said drill rod at predetermined intervals as said drill rod rotates wherein said means for selectively exerting thrust on said drill bit functions in response to the angular position of the bent-sub sensed by said monitoring means.

4. The drilling apparatus of claim 1, further comprising an eccentric stabilizer connected to said bent-sub.

5. The drilling apparatus of claim 1, wherein said bent-sub is a double-bent-sub.

6. The drilling apparatus of claim 5, further comprising a concentric stabilizer connected to said double-bent-sub.

7. A drilling apparatus for drilling a borehole comprising:
(a) a drill rod having a drill bit;
(b) a bent-sub connected with said drill rod behind said drill bit to position said drill bit to extend angularly with respect to said drill rod;
(c) piston-cylinder actuators for exerting thrust along the axis of said drill rod on said drill bit;
(d) means for rotating said drill rod and said drill bit; and
(e) means for controlling said means for exerting thrust, comprising means for selectively exerting thrust on said drill bit along said drill rod at predetermined intervals as said drill rod rotates.

8. The drilling apparatus of claim 7, wherein said piston-cylinder actuators are hydraulic rams.

9. A method for controlling directional drilling of a bit on the end of a drillstring, comprising the steps of:
(a) providing a drill rod with a drill bit and bent-sub;
(b) rotating said drill rod; and
(c) selectively exerting thrust forces along the axis of the drill rod at predetermined angular positions of the drill bit as the drill rod rotates for changing the direction of drilling.

10. The method of claim 9, further comprising the step of monitoring said drillstring while said drillstring rotates.

11. The method of claim 10, further comprising the step of controlling said exertion of said thrust forces in response to signals received by the step of monitoring.

12. The method of claim 9, wherein said step of rotating said drill rod is performed outside of a borehole within which said drillstring extends.

* * * * *